US007008020B2

(12) United States Patent
Becker et al.

(10) Patent No.: US 7,008,020 B2
(45) Date of Patent: Mar. 7, 2006

(54) INFLATABLE FURNITURE HAVING A STORAGE COMPARTMENT

(76) Inventors: Irving S. Becker, 103 Bellefair La., West Chester, PA (US) 19382; Laura E. Becker, 103 Bellefair La., West Chester, PA (US) 19382; Marcy B. Kwiatkowski, 91 Dean Rd., Mendham, NJ (US) 07945; Kevin C. Kwiatkowski, 91 Dean Rd., Mendham, NJ (US) 07945; Lori B. Leif, 7C Mead St., Stamford, CT (US) 06907; Fredric I. Leif, 7C Mead St., Stamford, CT (US) 06907; Jody B. Zohn, 217 Katherine Blvd. #2102, Palm Harbor, FL (US) 34684

( * ) Notice: Subject to any disclaimer, the term of this patent is extended or adjusted under 35 U.S.C. 154(b) by 38 days.

(21) Appl. No.: 10/328,120

(22) Filed: Dec. 23, 2002

(65) Prior Publication Data

US 2003/0117005 A1 Jun. 26, 2003

Related U.S. Application Data

(60) Provisional application No. 60/342,275, filed on Dec. 24, 2001.

(51) Int. Cl.
*A47C 7/02* (2006.01)

(52) U.S. Cl. ..... 297/452.41; 297/DIG. 3

(58) Field of Classification Search ..... 297/452.41, 297/272.3, DIG. 3; 5/706
See application file for complete search history.

(56) References Cited

U.S. PATENT DOCUMENTS

| | | | | | |
|---|---|---|---|---|---|
| 3,181,913 | A | * | 5/1965 | Lewis et al. | 297/462 |
| 3,272,199 | A | * | 9/1966 | Matthews | 600/21 |
| 3,584,914 | A | * | 6/1971 | Williams | 297/452.41 |
| 4,026,286 | A | * | 5/1977 | Trexler | 128/205.26 |
| 4,103,369 | A | * | 8/1978 | Riordan | 52/2.14 |
| 4,179,158 | A | * | 12/1979 | Flaum et al. | 297/440.17 |
| 4,223,474 | A | * | 9/1980 | Strauss | 446/221 |
| 4,232,477 | A | * | 11/1980 | Lin | 446/71 |
| 4,335,538 | A | * | 6/1982 | Greenberg | 446/220 |
| 4,627,659 | A | * | 12/1986 | Hall | 297/488 |
| 5,102,364 | A | * | 4/1992 | Kubiatowicz | 446/220 |
| 5,108,339 | A | * | 4/1992 | Kieves | 446/221 |
| 5,250,002 | A | * | 10/1993 | Kinberg | 446/220 |
| 5,254,026 | A | * | 10/1993 | Kaiser | 446/220 |
| 5,471,797 | A | * | 12/1995 | Murphy | 52/2.17 |
| 5,566,512 | A | * | 10/1996 | Page | 52/2.16 |
| 5,632,055 | A | * | 5/1997 | Graf | 5/706 |
| 5,947,563 | A | * | 9/1999 | Klimenko | 297/452.41 |
| 5,947,581 | A | * | 9/1999 | Schrimmer et al. | 362/96 |
| 6,042,186 | A | * | 3/2000 | Kojic et al. | 297/452.41 |
| 6,061,969 | A | * | 5/2000 | Leary | 52/2.11 |
| 6,089,668 | A | * | 7/2000 | Peterson | 297/452.41 |
| 6,152,530 | A | * | 11/2000 | Hsu et al. | 297/272.3 |

(Continued)

FOREIGN PATENT DOCUMENTS

EP 1166684 A1 * 1/2002

(Continued)

*Primary Examiner*—Rodney B. White
*Assistant Examiner*—Stephen D. D'Adamo
(74) *Attorney, Agent, or Firm*—Buckley, Maschoff & Talwalkar LLC

(57) ABSTRACT

According to some embodiments, an inflatable furniture structure is provided. The inflatable furniture structure may include, for example, at least one inflatable compartment and a least one storage compartment having a transparent surface.

7 Claims, 4 Drawing Sheets

U.S. PATENT DOCUMENTS 6,161,902 A * 12/2000 Lieberman ..... 297/452.41
6,209,962 B1 * 4/2001 Sobel et al. ..... 297/452.17
D446,949 S * 8/2001 Linder ..... D6/335
6,328,385 B1 * 12/2001 Lau ..... 297/452.41
6,532,613 B1 * 3/2003 Berry, IV ..... 5/655.4
6,568,011 B1 * 5/2003 Fisher et al. ..... 5/706
6,568,012 B1 * 5/2003 Michaelis et al. ..... 5/706

FOREIGN PATENT DOCUMENTS

WO WO 200074533 A1 * 12/2000

* cited by examiner

INFLATABLE FURNITURE HAVING A STORAGE COMPARTMENT

CROSS-REFERENCE TO RELATED APPLICATION

The present application claims the benefit of U.S. Provisional Application No. 60/342,275 entitled "Inflatable Furniture Having a Storage Compartment" and filed Dec. 24, 2001.

FIELD

The present invention relates to inflatable furniture. In particular, an embodiment of the present invention is directed to a piece inflatable furniture having a storage compartment.

BACKGROUND

Many people enjoy owning collectable items, such as BEANIE BABY® brand dolls manufactured by TY® INC. Often, a person may own a large number of collectible items, such as hundreds of BEANIE BABY® dolls. As a result, the items can occupy a significant amount of space (e.g., in a child's room). Moreover, because the person enjoys looking at the collectable items, he or she may prefer to store the items where they can be seen (e.g., rather than storing the items in a closet). Also note that collectable items can be quite valuable, and the person may want his or her items to protected and preserved while they are stored.

It is known that collectable items can be stored in a display case, such as a display case having a glass door. Although this may protect the items, it can still prevent a significant amount of space from being used for other purposes. It is also known that a coffee table can include a glass table-top over a small storage area. Unfortunately, such furniture can be inappropriate for children (e.g., the glass may break) and can be difficult to move from place to place.

SUMMARY

To alleviate these problems, embodiments of the present invention introduce inflatable furniture having a storage compartment.

DETAILED DESCRIPTION

Embodiments of the present invention are directed to inflatable furniture having a storage compartment. As used herein, the word "furniture" may refer to, for example, a chair, a sofa, a couch, a love seat, a table (e.g., a coffee table or an end table), a pillow, a cushion, a bean-bag, a stool, or an ottoman. Moreover, the phrase "inflatable furniture" may refer to any piece of furniture having at least one inflatable compartment.

Figure 1:
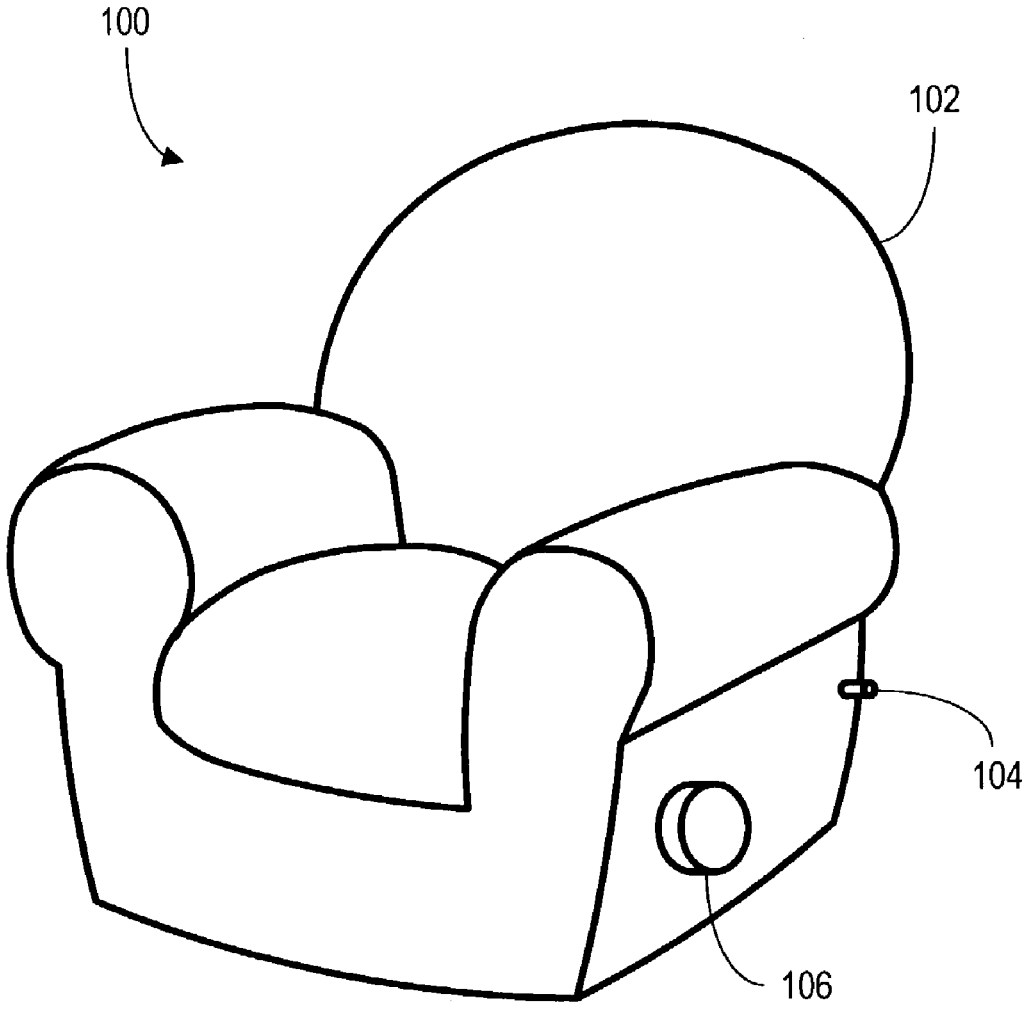
FIG. 1 is an inflatable chair according to an embodiment of the present invention.

Turning now to the drawings, FIG. 1 is an inflatable chair 100 according to an embodiment of the present invention. The inflatable chair 100 includes a surface portion 102 of an inflatable compartment. In particular, the inflatable chair 100 illustrated in FIG. 1 has a single inflatable compartment. The surface portion 102 may be made from, for example, a rubberized fabric or a plastic material, such as polyvinyl chloride (PVC) plastic. Any suitable flexible material capable of being sealed against leakage of a gas, particularly air, can be used as the surface portion 102.

The inflatable chair 100 also includes at least one storage compartment. With respect to the inflatable chair 100 shown in FIG. 1, the entire inflatable compartment also acts as a storage compartment. That is, as will be explained, a person may store items within the entire inflatable compartment.

The inflatable chair 100 also includes at least one transparent surface (e.g., at least one area on the storage compartment is transparent). As used herein, a "transparent surface" means any surface that can be seen through, including semi-transparent areas (e.g., a substantially clear surface having a blue tint). The entire surface portion 102 of the chair shown in FIG. 1 may be transparent (i.e., a clear plastic material). According to another embodiment, only a portion of the surface portion 102 is transparent (e.g., a see-through "window" may be provided).

The inflatable chair 100 also includes an inflation aperture 104 through which a person can inflate the inflatable chair 100. Various types of appropriate inflation apertures 104 are known to those skilled in the art. A person may couple a motorized pump, a hand or foot pump, or his or her mouth to the inflation aperture 104 in order to inflate the inflatable chair 100. Note, however, that when a person inflates the inflatable chair 100 with his or her mouth, moisture might be introduced causing damage to items stored inside the inflatable chair 100 (e.g., mold or mildew could form when items are stored for an extended period of time). According to one embodiment, at least one de-moisturizing substance (e.g., a desiccant) is contained within the inflatable chair 100 to reduce such moisture.

The inflatable chair 100 also includes an item aperture 106 through which a person can place items into the inflatable chair 100. According to one embodiment, the item aperture 106 includes a lid that can be screwed in place to prevent air from leaving the inflatable chair 100. According to one embodiment, the item aperture 106 is similar to apertures known to those skilled in the art (e.g., apertures that are used to rapidly deflate large items, such as inflatable mattresses and boats), although the item aperture 106 may be larger than normal depending on the size of the items to be stored in the inflatable chair 100 (e.g., an item aperture 106 having a 3.5 inch diameter may be appropriate to store BEANIE BABY® dolls).

In this way, a person may open the item aperture 106 and place items within the storage compartment. The person may then seal the item aperture 106 and inflate the inflatable chair 100 via the inflation aperture 104. According to one embodiment, a significant number of items may be stored in the storage compartment (e.g., the inflatable chair 100 might be almost completely filled with items). The items are therefore conveniently stored and protected (e.g., inflation may reduce the pressure exerted on items when someone sits on the inflatable chair 100), and the person can still enjoy his or her items (e.g., by viewing the items through the transparent surface).

Figure 2:
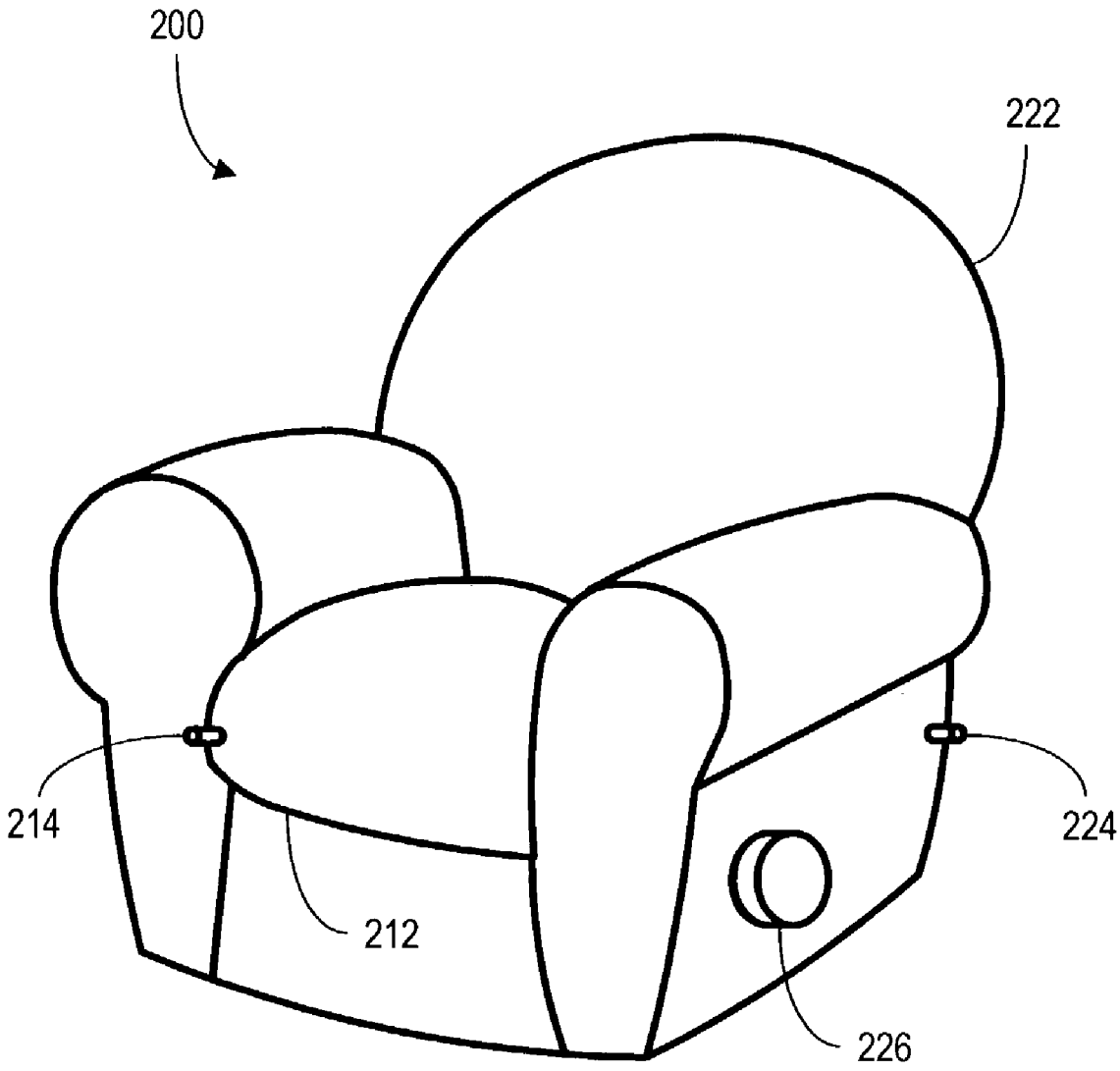
FIG. 2 is an inflatable chair having a plurality of inflatable compartments according to an embodiment of the present invention.

FIG. 2 is an inflatable chair 200 having a plurality of inflatable compartments 212, 222 according to an embodiment of the present invention. In particular, a first inflatable compartment 212 acts a seat cushion and a second inflatable compartment 222 acts as the rest of the chair. In this case, only the second inflatable compartment 222 also acts as a storage compartment. Thus, both inflatable compartments 212, 222 have inflation apertures 214, 224—but only the second inflatable compartment 222 has an item aperture 226. Note that items stored in the second inflatable compartment 222 are further protected by the presence of the first inflatable compartment 212 (e.g., the first inflatable compartment 212 further reduces pressure exerted on items when someone sits on the inflatable chair 200).

Figure 3:
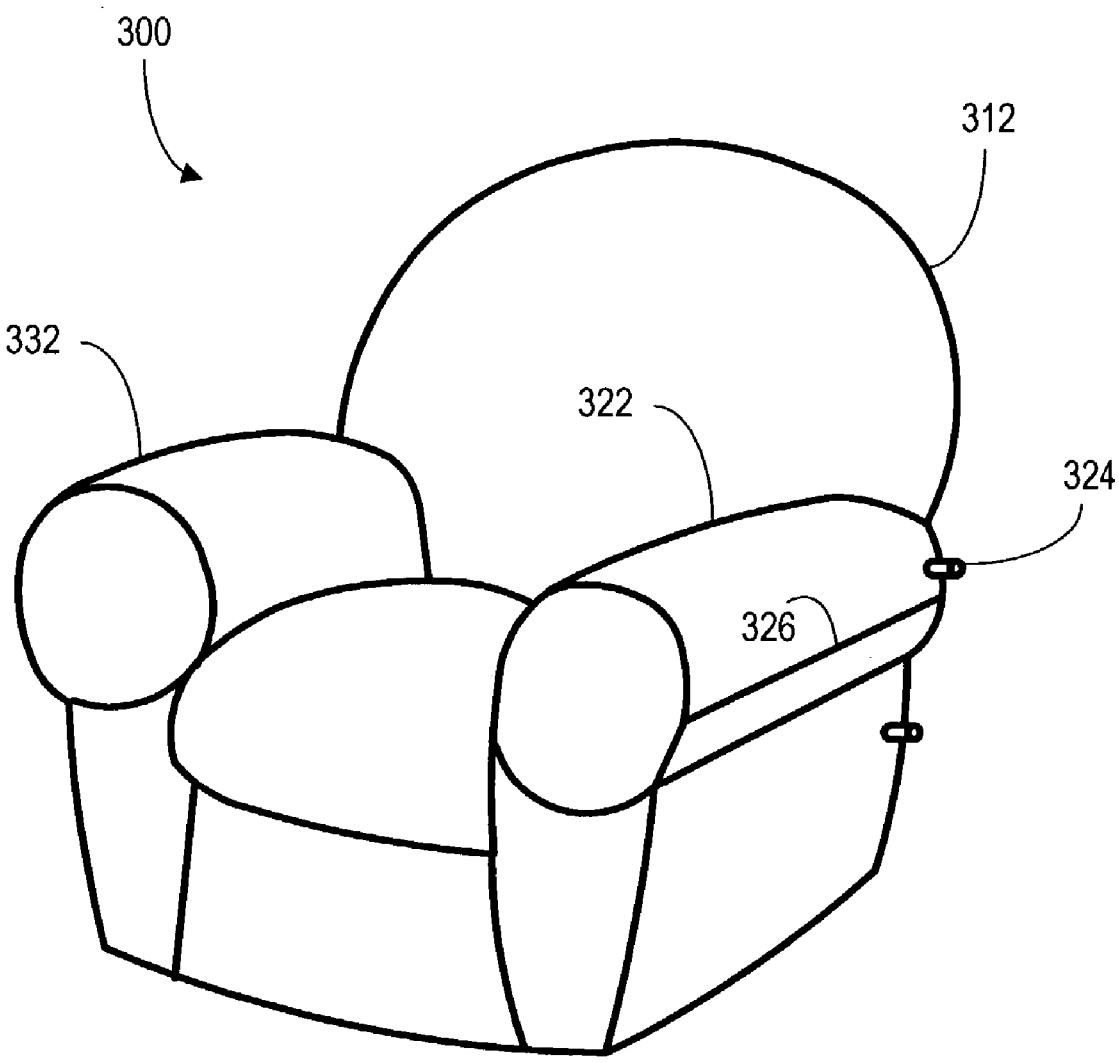
FIG. 3 is an inflatable chair having a plurality of storage compartments according to an embodiment of the present invention.

FIG. 3 is an inflatable chair 300 having a plurality of storage compartments according to an embodiment of the present invention. In this case, the inflatable chair 300 includes an inflatable main body 312 (i.e., which does not act as a storage compartment), and two inflatable arm rests 322, 332 that also act as a storage compartments. Thus, the first arm rest 322 has an inflation aperture 324 and an item aperture 326. In this case, the item aperture 326 is an air-tight zip lock seal through which a person can place items into the first arm rest 322 for storage. The second arm rest 332 may also include an inflation aperture and item aperture (not shown in FIG. 3).

Figure 4:
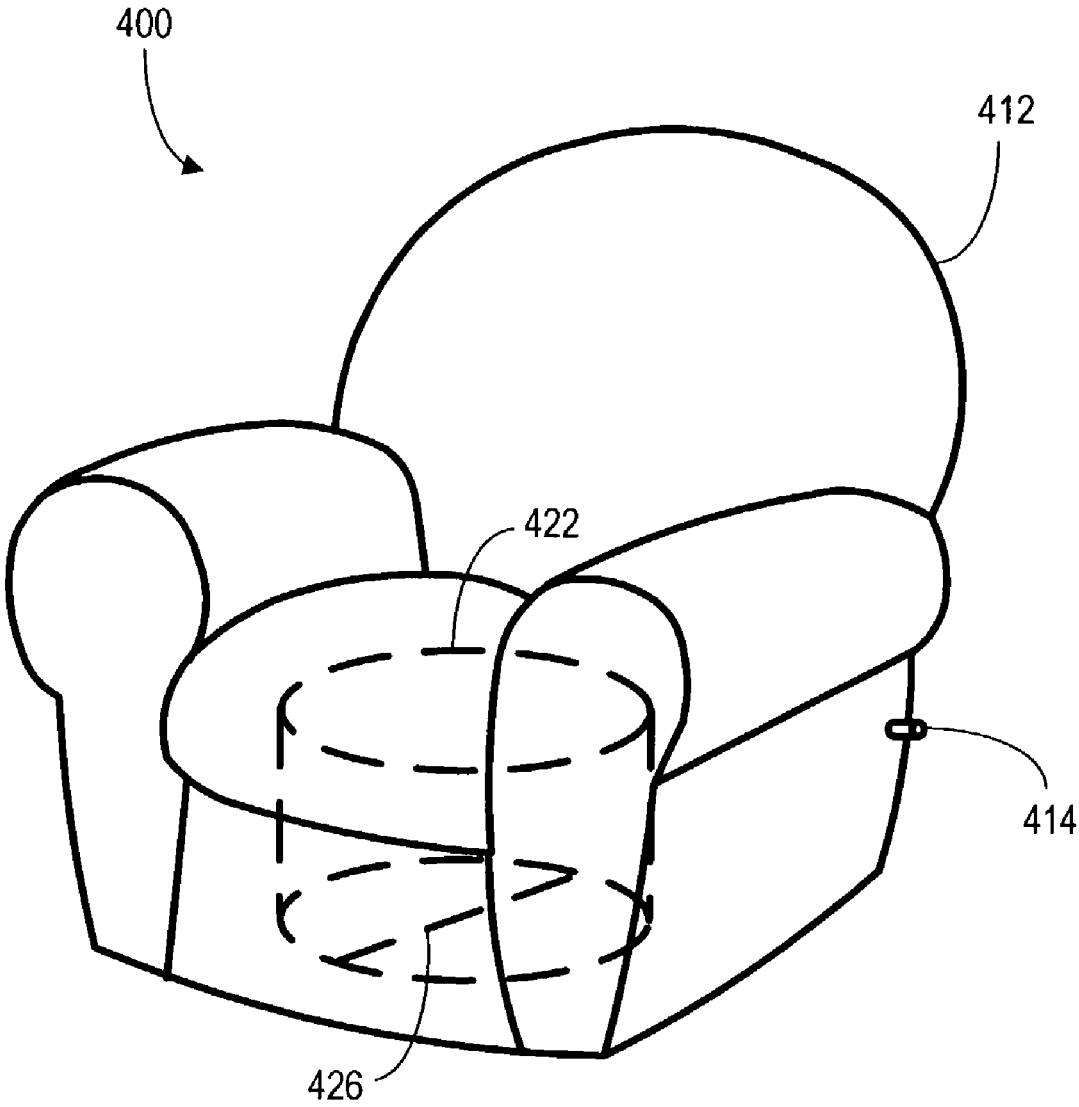
FIG. 4 is an inflatable chair having a non-inflatable storage compartment according to an embodiment of the present invention.

FIG. 4 is an inflatable chair 400 having a non-inflatable storage compartment 422 according to an embodiment of the present invention. In this case, the inflatable chair 400 is comprised of an inflatable compartment 412 having an inflation aperture 414. The inflatable chair 400 also includes a cylindrical non-inflatable storage compartment 422. The bottom surface of the storage compartment 422 includes a slit 426 (e.g., a slit 426 that does not need to be air-tight). The person can place items through this slit 426 for storage.

ADDITIONAL EMBODIMENTS

The following illustrates various additional embodiments of the present invention. These do not constitute a definition of all possible embodiments, and those skilled in the art will understand that the present invention is applicable to many other embodiments. Further, although the following embodiments are briefly described for clarity, those skilled in the art will understand how to make any changes, if necessary, to the above-described apparatus and methods to accommodate these and other embodiments and applications.

Although several embodiments have been shown with respect to inflatable chairs, the present invention is applicable to any type of inflatable furniture. For example, an inflatable rectangular table may be provided. In this case, the top of the table may be covered with a transparent inflexible material (e.g., so that the table can be used for writing while allowing items stored within the table to be seen).

Similarly, although several examples have been described with respect to BEANIE BABY® dolls, other types of collectable items can similarly be stored in accordance with the present invention. For example, other types of plush dolls or action figures may be stored. Of course, even items that are not "collectable" may be stored, such as items of personal interest or value.

What is claimed:

1. An inflatable chair, comprising:

an inflatable storage compartment including a transparent surface portion;

an inflation aperture into the inflatable storage compartment;

a collectable item aperture into the inflatable storage compartment; and a plush doll within the inflatable storage compartment, the plush doll being received through the collectable item aperture and viewable through the transparent surface portion, wherein the inflatable storage compartment defines a single, contiguous volume of the chair to contain pressurized air when inflated, and further wherein no membrane separates the pressurized air and the plush doll when inflated.

2. The inflatable chair of claim 1, wherein the collectable item aperture is substantially larger than the inflation aperture.

3. The inflatable chair of claim 1, wherein the collectable item aperture includes at least one of: (i) a lid to be screwed in place, or (ii) a zip-lock seal.

4. The inflatable chair of claim 1, wherein the inflatable storage compartment further includes at least one de-moisturizing substance.

5. The inflatable chair of claim 1, wherein at least a portion of the inflatable storage compartment comprises at least one of: (i) a rubberized fabric, (ii) a plastic material, or (iii) a polyvinyl chloride plastic.

6. The inflatable chair of claim 1, wherein the structure includes a plurality of inflatable storage compartments.

7. The inflatable chair of claim 1, wherein the inflation aperture and collectable item aperture can be sealed to prevent air from exiting the inflatable storage compartment.

* * * * *